US009365964B2

(12) United States Patent
Kim

(10) Patent No.: US 9,365,964 B2
(45) Date of Patent: Jun. 14, 2016

(54) APPARATUS FOR WHIPPING BUTTON SEWING THREAD

(71) Applicant: Hyeong Gi Kim, Seoul (KR)

(72) Inventor: Hyeong Gi Kim, Seoul (KR)

( * ) Notice: Subject to any disclaimer, the term of this patent is extended or adjusted under 35 U.S.C. 154(b) by 160 days.

(21) Appl. No.: 14/205,693

(22) Filed: Mar. 12, 2014

(65) Prior Publication Data

US 2015/0040809 A1 Feb. 12, 2015

(30) Foreign Application Priority Data

Aug. 12, 2013 (KR) ..... 10-2013-0095344

(51) Int. Cl.
*D05B 3/16* (2006.01)

(52) U.S. Cl.
CPC ..... *D05B 3/16* (2013.01)

(58) Field of Classification Search
CPC ..... A41H 37/10; A41H 37/001; D05B 3/14; D05B 3/16
See application file for complete search history.

(56) References Cited

U.S. PATENT DOCUMENTS 4,426,942 A * 1/1984 Nestenius ..... D05B 81/00 112/108
5,082,151 A * 1/1992 Schaerer ..... A41H 37/005 112/108
6,029,867 A * 2/2000 Lee ..... A41H 37/005 2/265
6,199,727 B1 * 3/2001 Suh ..... D05B 3/14 112/108
7,488,011 B2 * 2/2009 Seo ..... A41H 37/10 289/15

FOREIGN PATENT DOCUMENTS

KR 20-0322717 Y1 8/2003
KR 10-0532713 B1 12/2005

* cited by examiner

*Primary Examiner* — Danny Worrell
(74) *Attorney, Agent, or Firm* — Novick, Kim & Lee, PLLC; Jae Youn Kim

(57) ABSTRACT

Disclosed is an apparatus for whipping a button sewing thread, capable of ensuring the operational convenience, reliability and durability by simplifying main elements of the apparatus. The apparatus includes a body including a holder for holding a sewed button; a tension control unit provided with a plurality of tensioners and a thread hook on a passage of the thread; a thread guide unit adjacent to the tension control unit to guide the thread toward the holder; a winding unit including a rotational arm for winding the thread around a sliding support linearly moving toward the holder; and a knotting unit including a separating arm linearly moving toward the holder in order to form a thread knot.

4 Claims, 5 Drawing Sheets

APPARATUS FOR WHIPPING BUTTON SEWING THREAD

BACKGROUND

The present invention relates to an apparatus for whipping a button sewing thread, and more particularly, to an apparatus for whipping a button sewing thread, capable of ensuring the operational convenience, reliability and durability by simplifying main elements of the apparatus.

In cases of typical clothes, buttons are sewed onto the clothes with a sewing thread (called a "root") to be spaced apart from each other by a predetermined distance so that the buttons easily enter buttonholes of the cloths. To improve the support strength of such a root, a plurality of knots is formed around peripheries of the buttons by using another sewing thread. Similarly to other industrial fields, various automatic machines have been developed in the field of a button sewing machine in order to improve productivity by saving labor force required for whipping a button sewing thread. The related arts have been disclosed in Korean Utility Model Registration No. 20-0322717 and Korean Patent No. 10-0532713.

According to the former related art, a plurality of guide bars for guiding a hemming thread in zigzag are provided and are instantly moved up in the late period of a hemming process to prevent the hemming thread from being released. When an air pressure for driving a latch piece of a button latch part is removed, the operation of the hemming device is automatically stopped to prevent the hamming thread from being tangled around the latch piece or the button base. Thus, it is expected to improve the efficiency of works related to the process of hemming the button base.

However, according to the above related art, the guide bars for guiding a hemming thread in zigzag may serve as main elements, so the knots are unstable and weak when the knots are formed at a high-speed operation, so that there may be a limitation in maintaining the stable hemming state.

According to the later related art, there is provided an apparatus for wrapping and knotting a thread to the side of a sewing button of a cloth. The apparatus includes a base, a button holder mounted on the base for supporting the button on the base, a knot guider for hooking the thread to the side surface of the button supported by the button holder to form a knot, a slider movable forward and rearward on the base, and a winding member having a winding arm for winding the thread around the side surface of the button. Thus, the thread may form a strong knot at the side surface of the sewing thread of the button so that the thread is not untied.

However, since the mechanical configuration of the knot guider for reciprocating and retracting motions to form a knot is complex, a malfunction may be caused due to abrasion and it is difficult to manage and maintain the knot guider, so that the durability may be deteriorated. In addition, when the thread is cut, the passage formed by the first and second tube members communicating with each other is complex so that it is inconvenient to resupply the thread.

SUMMARY

Accordingly, it is an object of the present invention to provide an apparatus for whipping a button sewing thread, capable of ensuring the operational convenience, convenient maintenance, reliability and durability by simplifying main elements of the apparatus.

According to the present invention, there is provided an apparatus for whipping a button sewing thread with a thread.

The apparatus includes a body including a holder for holding a sewed button; a tension control unit provided with a plurality of tensioners and a thread hook on a passage of the thread; a thread guide unit adjacent to the tension control unit to guide the thread toward the holder; a winding unit including a rotational arm for winding the thread around a sliding support linearly moving toward the holder; and a knotting unit including a separating arm linearly moving toward the holder in order to form a thread knot.

According to the present invention, the thread hook of the tension control unit has a hole adjacent to a downstream tensioner, and performs a thread hooking operation in cooperation with an air cylinder.

According to the present invention, the thread guide unit is formed with a through hole extending to an end of the rotational arm and includes an air nozzle at an upstream end of the through hole to convey the thread.

According to the present invention, the sliding support of the winding unit includes a spline shaft and is installed to a motor support such that the sliding support is linearly movable through the spline shaft, and the rotational arm receives a torque through a driving motor and the motor support.

According to the present invention, the knotting unit includes an air cylinder for moving the separating arm back and forth and a convey motor for moving the rotational arm back and forth.

As described above, according to the present invention, the main elements of the apparatus and the transferring passage of the thread can be simplified so that the operational convenience and the maintenance can be improved. In addition, the reliability in the operation of wrapping the button sewing thread and durability can be achieved.

DETAILED DESCRIPTION OF THE EMBODIMENTS

Hereinafter, the embodiments of the present invention will be described with reference to the accompanying drawings.

Figure 1:
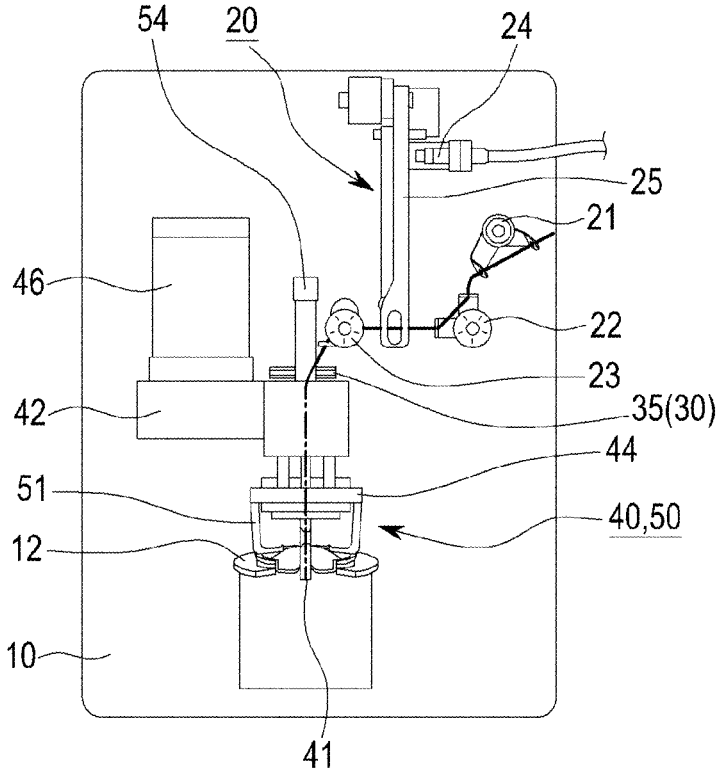
FIG. 1 is a plane view showing an entire apparatus according to an embodiment of the present invention.
Figure 2:
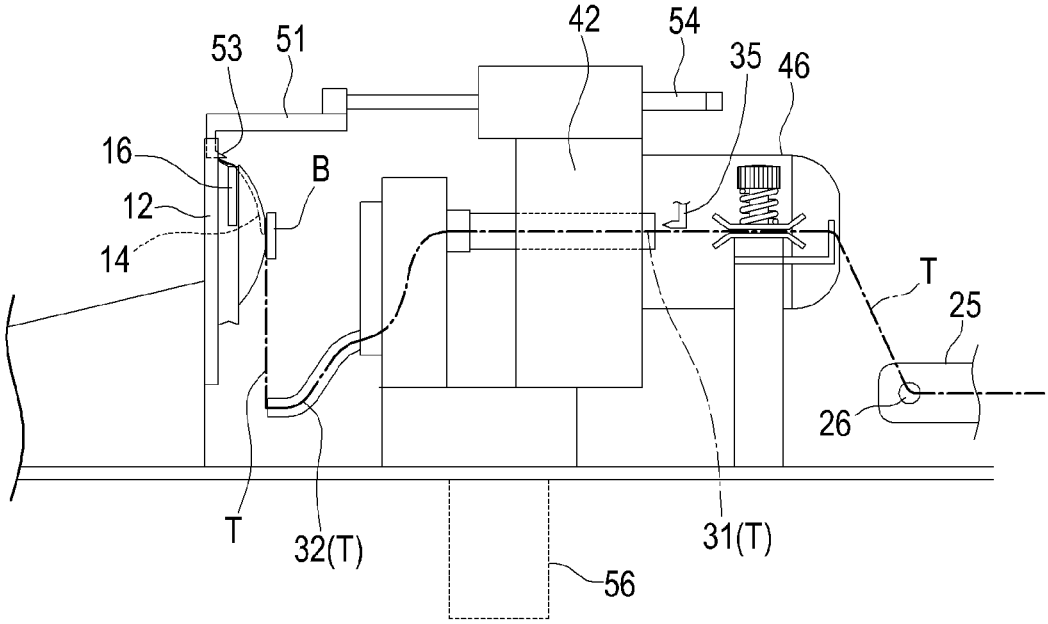
FIG. 2 is a view illustrating a winding operation of an apparatus according to an embodiment of the present invention.

As shown in FIGS. 1 and 2, the present invention provides an apparatus for whipping a sewing thread of a button B with a thread. The button B is provided to the apparatus according to the present invention in the state the button B is sewed to clothes. In this case, the thread used to couple the button B to the clothes is called a sewing thread (is called a root). Another thread T is provided to another apparatus according to the present invention to surround the sewing thread between the conventional clothes and the button B so that the sewing thread is reinforced.

As shown in FIGS. 1 and 2, a body 10 according to the present invention has a holder 12 to which the sewed button B is held. The holder 12, which is a member having a circular shape and a substantially curved surface, is fixed to the top surface of the body 10. The curved surface of the holder 12 is provided to allow the button B attached to the clothes to be placed thereon so that the position of the button is fixed to expose a sewing line. Referring to FIG. 1, a lower direction, in which the holder 12 of the body 10 is placed, is referred to as a front direction or surface, and an upper direction is referred to as a rear direction or surface.

In this case, the holder 12 of the body 10 includes a straight groove 14, a V-shaped groove 15, and a concave groove 16. The straight groove 14 is formed by incising the holder 12 in the longitudinal direction such that the sewing thread of the button B is held while passing through the straight groove 14. The V-shaped groove 15 is incised toward an upper side of the straight groove 14 such that the separating arm 51 described later is rested therein. The concave groove 16 is formed on a rear surface of the holder 12 in an arc shape to knot the thread T in a figure "8" shape.

A tension control unit 20 according to the present invention includes tensioners 21, 22 and 23 and a thread hook 25 on a passage of the thread T. The thread T is provided to the holder 12 from a rear side end through a tensioner 21 positioned upstream, a middle tensioner 22 and a tensioner 23 positioned downstream. A thread hook 25 is disposed between the tensioners 21 to 23 to maintain the tension necessary when the thread T is wound and knotted.

The thread hook 25 of the tension control unit 20 has a hole 26 formed adjacent to the tensioner 23 positioned downstream and the tension control unit 20 performs the thread hooking operation in cooperation with an air cylinder 24. The thread hook 25 provides a tension to the thread T which passes intermittently through the hole 26 in an up-and-down motion to help the thread T to be wound and knotted. When the hole 26 is adjacent to the tensioner 23 positioned downstream), the relaxation of the thread T is reduced so that there are advantages of always providing a suitable tension. A hinge is installed at an opposite side to the hole 26 of the thread hook 25 such that the intermittent movement of the hinge toward the air cylinder 24 in an up-and-down motion is induced. Thus, the configuration for the operation of the thread hook 25 is simple and it is easy to adjust the tension through the air pressure control.

Further, according to the present invention, a thread guide unit 30 is installed adjacent to the tension control unit 20 to guide the movement of the thread T toward the holder 12. The thread guide unit 30 allows the thread T passing through the thread hook 25 and the tensioner 23 of the tension control unit 20 to move smoothly through a rotational arm 41 described below and to be installed quickly and conveniently at a first work stage and during working. The detailed configuration of the thread guide unit 30 will be described below.

According to the present invention, the winding unit 40 includes the rotational arm 41 for allowing the thread T to be wound around a sliding support 44 linearly moving in the direction of the holder 12. The winding unit 40 performs the function of winding the thread T along a periphery of a sewing line of the button B by using the holder 12 and the rotational arm 41. The separating arm 51 has a shape of a bending tube and is eccentrically fixed onto the sliding support 44. The sliding support 44 is installed on the upper surface of the body 10 such that the sliding support 44 may linearly move back and forth with respect to the holder 12.

The sliding support 44 is installed to a motor support 42 such that the sliding support 44 can linearly move through the spline shaft 43 interposed between the sliding support 44 and the motor support 42. The rotational arm 41 receives a torque through a driving motor 46 and the motor support 42. The torque of the driving motor 46 is transferred to the spline shaft 43 through the motor support 42. The motor support 42 includes a gear and a timing belt and is fixed to the body 10 while being received in a housing. The sliding support 44 is connected to the spline shaft 43 in a rear direction and is provided with the rotational arm 41 in a front direction. Thus, when the thread T is wound and knotted, the torque of the driving motor 46 may be continuously provided to the rotational arm 41 while the sliding support 44 is linearly moving.

In addition, according to the present invention, a knotting unit 50 linearly moves toward the holder 12 and includes the separating arm 51 for forming a knot of the thread T. The knotting unit 50 knots the thread T which is wound around the periphery of the button B by using the holder 12 and the separating arm 51. A guide rail is provided to an upper end of the motor support 42 such that the separating arm 51 is coupled to the guide rail to be movable in a linear motion.

Figure 4:
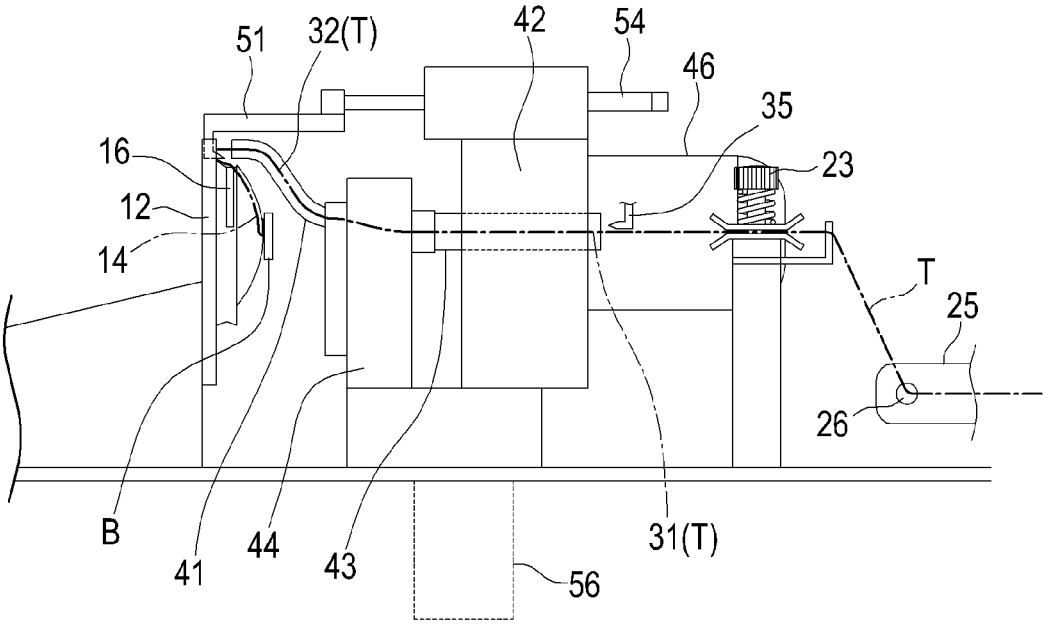
FIGS. 4 and 5 are views illustrating a winding operation of an apparatus according to an embodiment of the present invention.

The knotting unit 50 includes an air cylinder 54 for allowing the separating arm 51 to move back and forth and a convey motor 56 for allowing the rotational arm 41 to move back and forth. The air cylinder 54 is fixed to the upper end of the motor support 42 such that the air cylinder 54 is connected to the guide rail. As shown in FIGS. 2 and 4, an end of the separating arm 51 approaches to or is spaced apart from the holder 12 as the air cylinder 54 is operated. The convey motor 56 is mounted on a lower surface of the body 10 and is connected to the sliding support 44 by interposing a gear between them. Although the sliding support 44 linearly moves forward and rearward as the convey motor 56 is operated, as described above, since the spline shaft 43 is interposed, the torque can be continuously transferred from the driving motor 46 to the rotational arm 41.

Figure 3:
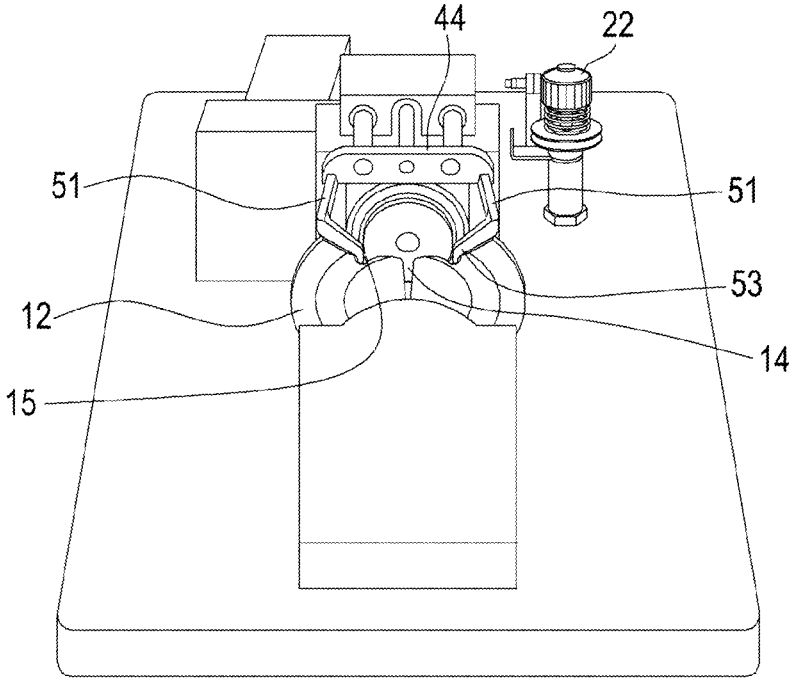
FIG. 3 is an enlarged view showing main elements for a knot operation of an apparatus according to an embodiment of the present invention.

Referring to FIG. 3, the separating arm 51 includes two members, each of which is bent in a reverse-L shape and is placed to be closest to the V shaped groove 15 of the holder 12. The separating arm 51 is provided at an end thereof with a latch piece 53, such that the thread T wound around the concave groove 16 of the holder 12 is exactly separated from the holder 12. The latch piece 53 is formed by bending the lower end of the bending member, which is bent in the reverse-L shape, in the rearward direction.

The thread guide unit 30 has a through-hole extending to the end of the rotational arm 41 and includes an air nozzle 35 for transferring the thread T from an upstream end of the through-hole. After the thread T has passed through the thread hook 25 and the tensioner 23, the thread T passes through the upstream through-hole 31 and the downstream through-hole 32 and then is supplied to the holder 12. The upper side through-hole 31 includes a hollow formed in the spline shaft 43 and the lower side through-hole 32 includes a hollow formed in the rotational arm 41. Since the through-holes 31 and 32 are integrally formed and the air nozzle 35 is provided at the end of the through-hole 31, the thread T can be quickly and conveniently introduced in the early stage of operation or during the operation.

Figure 5:
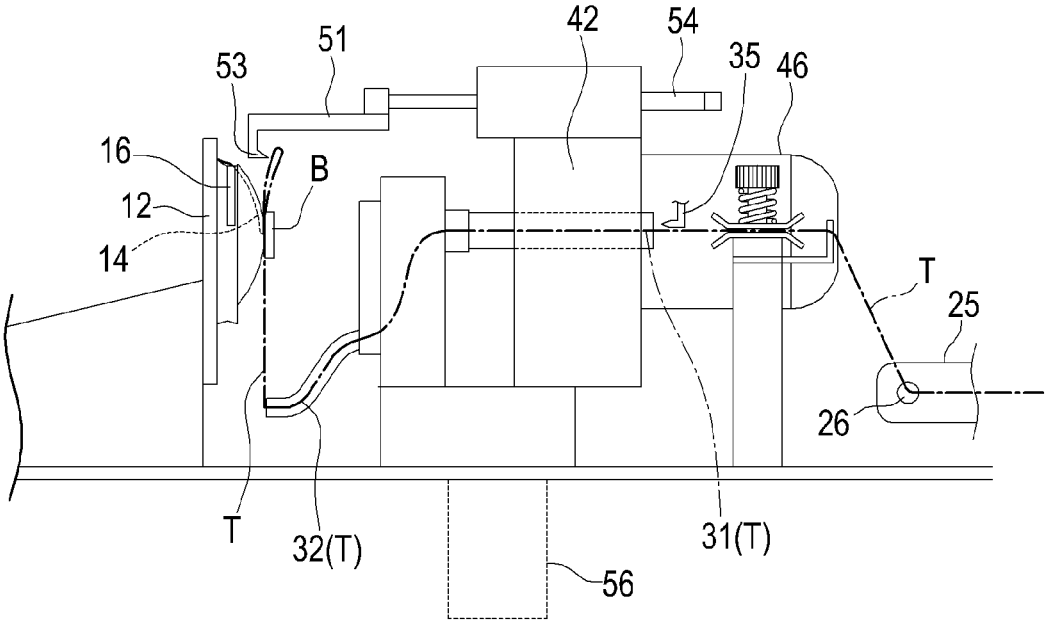

The operations of the apparatus according to the present invention may be widely divided into the winding operation of FIG. 2 and the knotting operation of FIGS. 4 and 5.

In FIG. 2, when a switch (not shown) is pressed in a state that the cloth makes contact with the holder 12 to expose the button B, the driving motor 46 and the convey motor 56 are operated to rotate and linearly move the rotational arm 41 so that the thread T is wound along the sewing line. The number of winding the thread T is preset in a controller (not shown).

In FIG. 4, when the thread T has been wound at the preset number, the sliding support 44 move forward so that the end of the rotational arm 41 arrives at the concave groove 16 of the holder 12. Thus, the rotational arm 41 winds the thread T around the concave groove 16. Then, as shown in FIG. 5, the air cylinder 54 is operated to retract the separating arm 51, so that the thread T of the concave groove 16 is separated, and at the same time, entangled with the thread T of the rotational arm 41, thereby forming the knot. The scheme of forming a knot having a figure "8" shape is generally known in the art.

In addition, the sequential operations of FIGS. 2, 4 and 5 may be repeated at the number of times preset in the controller.

Although an exemplary embodiment of the present invention has been described for illustrative purposes, those skilled in the art will appreciate that various modifications, additions and substitutions are possible, without departing from the scope and spirit of the invention as disclosed in the accompanying claims. In addition to variations and modifications in the component parts and/or arrangements, alternative uses will also be apparent to those skilled in the art.

What is claimed is:

1. An apparatus for whipping a button sewing thread with a thread, the apparatus comprising:

a body including a holder for holding a sewed button;

a tension control unit including a plurality of tensioners and a thread hook disposed on a passage of the thread;

a thread guide unit disposed adjacent to the tension control unit to guide the thread toward the holder;

a winding unit including a rotational arm for winding the thread around a sliding support linearly movable toward and from the holder; and a knotting unit including a separating arm linearly movable toward and from the holder in order to form a thread knot, wherein the knotting unit includes an air cylinder for moving the separating arm back and forth and a convey motor for moving the rotational arm back and forth.

2. The apparatus of claim 1, wherein the thread hook of the tension control unit has a hole disposed adjacent to a downstream tensioner of the plurality of tensioners, and another air cylinder, and performs a thread hooking operation.

3. The apparatus of claim 1, wherein the thread guide unit includes a through hole extending to an end of the rotational arm and includes an air nozzle at an upstream end of the through hole to convey the thread.

4. The apparatus of claim 1, wherein the sliding support of the winding unit includes a spline shaft and is installed to a motor support such that the sliding support is linearly movable through the spline shaft, and the rotational arm receives a torque through a driving motor and the motor support.

* * * * *